United States Patent [19]

Worley

[11] 4,444,157

[45] Apr. 24, 1984

[54] LIQUID COOLED TUBE SUPPORTS

[75] Inventor: Arthur C. Worley, Mt. Tabor, N.J.

[73] Assignee: Exxon Research and Engineering Co., Florham Park, N.J.

[21] Appl. No.: 448,838

[22] Filed: Dec. 10, 1982

[51] Int. Cl.[3] ..... F22B 37/24

[52] U.S. Cl. ..... 122/510; 122/511; 122/365; 165/104.21

[58] Field of Search ..... 122/510, 511, 365; 165/162, 104.21, 47 H

[56] References Cited

U.S. PATENT DOCUMENTS

| | | | |
|---|---|---|---|
| 2,268,730 | 1/1942 | Vagt | 122/510 |
| 2,456,786 | 12/1948 | Kniel et al. | 122/356 |
| 3,385,271 | 5/1968 | Fleischer | 122/510 |
| 3,552,362 | 1/1971 | Francis | 122/510 |
| 3,633,665 | 1/1972 | France | 165/104.21 |
| 3,696,862 | 10/1972 | Dijk | 122/356 |
| 3,938,476 | 2/1976 | Kaupp | 122/356 |
| 4,244,606 | 1/1981 | Abrahamson | 285/14 |
| 4,368,695 | 1/1983 | Davies | 122/510 |
| 4,387,668 | 6/1983 | Kochey, Jr. | 122/6 A |

*Primary Examiner*—Henry C. Yuen

*Attorney, Agent, or Firm*—Joseph J. Dvorak

[57] ABSTRACT

In boilers, process tubes are suspended by means of vertical tubular supports that are in thermal contact with and attached to the metal roof casing of the boiler and the upper bend portions of the process tubes. The tubular supports have a liquid sealed within the support so that under conditions the liquid refluxes thereby rejecting heat to the atmosphere above the roof casing of the boiler.

9 Claims, 2 Drawing Figures

LIQUID COOLED TUBE SUPPORTS

FIELD OF THE INVENTION

The present invention relates to boiler tube supports and particularly to process tube supports for hybrid boilers.

BACKGROUND OF THE INVENTION

There are a number of techniques disclosed in the art for locating process tubes within high temperature boilers. Illustrative of such techniques are those disclosed in U.S. Pat. Nos. 3,385,271; 3,552,362 and 4,244,606. In actual practice, however, it is most common to have the process tubes which are located in boilers suspended by tube supports from a superstructure external the boiler roof casing. Thus, the process tubes located in the boiler have upper portions which extend through the boiler roof casing, form a bend, and return back down through the boiler roof casing. The tubes are suspended by tube supports attached to the bend of the tube and superstructure over the roof casing. Experience has shown that these precautions are necessary to avoid mechanical failure of the tube supports which would occur if the supports were located within the boiler where temperatures are generally above at least 1000° F. and often are as high as about 2000° F. and a corrosive atmosphere exists.

There are a number of disadvantages to the common tube support technique in practice, not the least of which is the difficulty associated with providing appropriate expansion joints in the region where the process tubes penetrate the casing of the boiler. Thus, there remains a need for a very simple and economical technique for supporting process tubes in a boiler chamber.

SUMMARY OF THE INVENTION

Briefly stated, a vertically disposed serpentine tubular coil is suspended within the convection section of a boiler chamber from the upper return bends of the tubular coil by means of metal supports which are in thermal contact with and attached to the upper return bends of the tubular coil. The supports pass through the insulation of the boiler roof and also are in thermal contact with and attached to the roof casing. Importantly, a liquid, such as water, is sealed within the tubular supports so that under conditions of use, the liquid in contact with that portion of the support within the boiler is heated and vaporized. The vaporized liquid is then condensed at the cooler portion of the support which is in contact with the roof casing. Thereafter, condensed liquid returns by gravity to portions of the support within the boiler thereby cooling the support.

In one embodiment of the invention, a metal sleeve and insulation are provided around that portion of the support which extends from the upper return bend of the tubular coil to the boiler roof insulation.

These and other features of the present invention will be better understood by reading a detailed description of the invention in connection with the drawings.

THE DRAWINGS

DETAILED DESCRIPTION OF THE INVENTION

Figure 1:
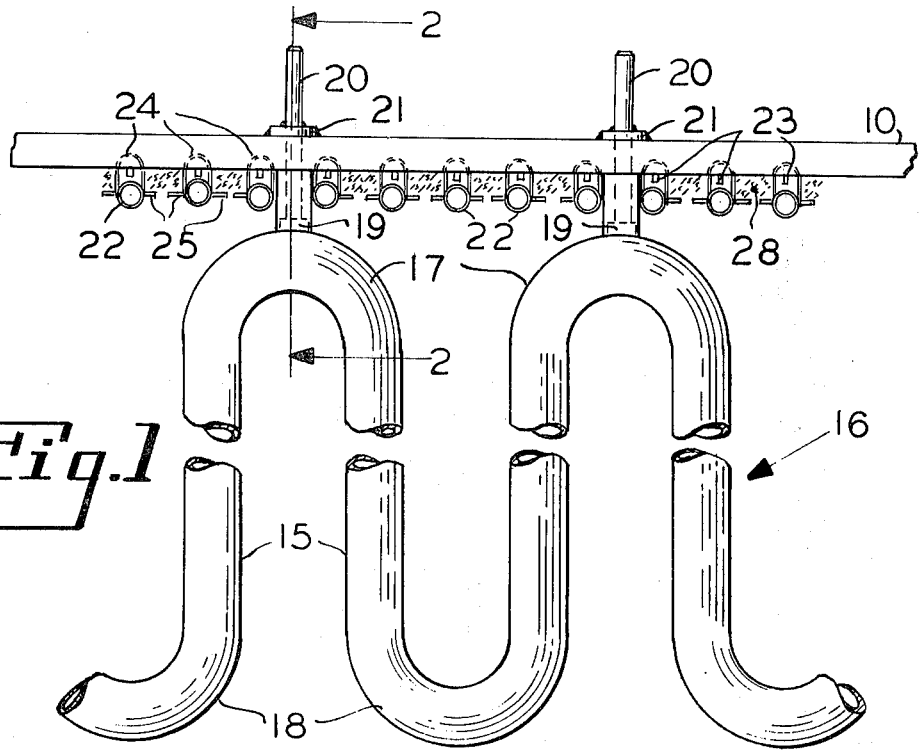
FIG. 1 is a schematic diagram illustrating the support of process tubes in a hybrid boiler in accordance with the present invention.
Figure 2:
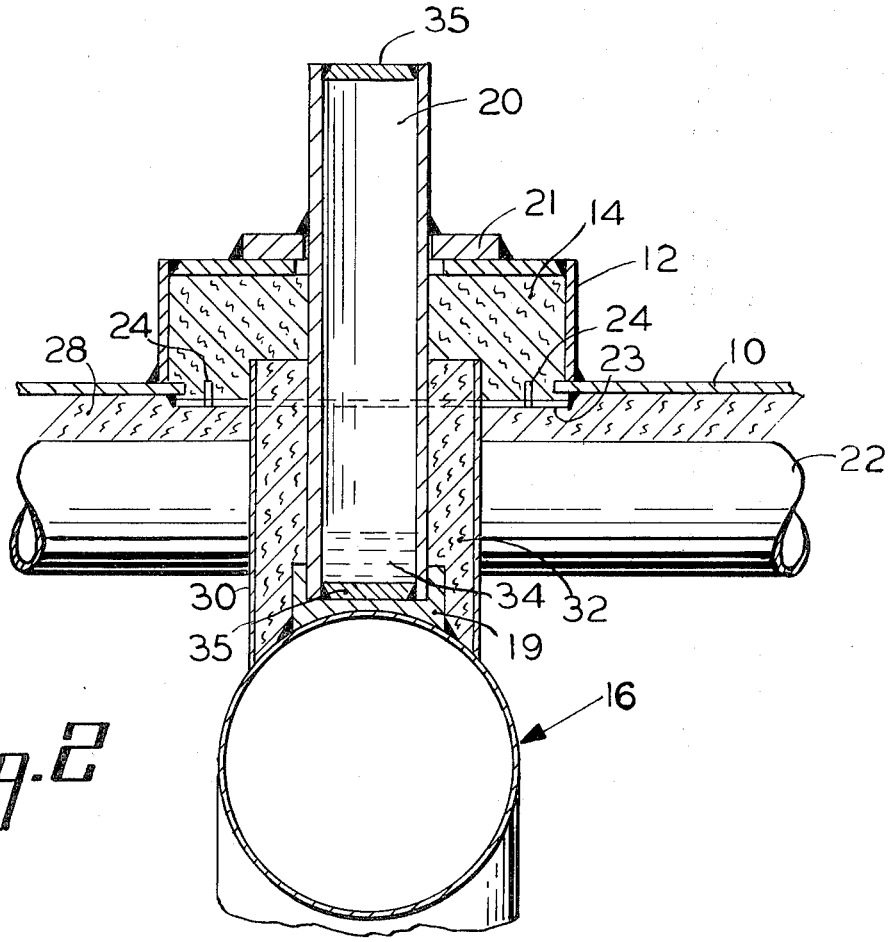
FIG. 2 is a cross-section of a view taken along lines 2,2 of FIG. 1.

Referring particularly to FIGS. 1 and 2 of the drawings, there is shown a metal roof casing 10 of a hybrid boiler. The boiler, of course, is provided with side walls and a floor (not shown) defining a convection section of the boiler. Preferably, roof casing 10 is provided with a plurality of upwardly directed channels 12 which extend along the length of the boiler roof. As can be seen in FIG. 2, an insulating material 14 is located within each of the upwardly directed channels 12. The insulating material is selected from typical boiler insulating materials such as refractory materials, ceramic fibers and the like.

Arranged within the convection section of the furnace are a plurality of serpentine tubes 16 for the passage therethrough of process fluid to be heated in the boiler. As shown in FIGS. 1 and 2, the serpentine process tube 16 has upper bend portions 17, lower bend portions 18 and straight run portions 15. The serpentine tube 16 is suspended in the boiler in accordance with the practice of the present invention as will be described herein in greater detail.

At substantially the mid-portion of each upper bend portion 17, there is provided a circular metal ring 19.

Ring 19 may be similar, for example, to a half socket welding pipe coupling. In any event, ring 19 is adapted to receive in engaging relationship and be in thermal contact with one end of tubular supporting 20. As is shown in the drawings, support 20 is attached by welding to ring 19; however, it should be readily appreciated that ring 19 and support 20 may be threaded so that support 20 can be screwed into ring 19.

Support 20 extends upwardly from ring 19 through the insulation 14 of channel 12 and through an opening in the roof casing 10 and roof casing reinforcing plate 21. The opening in the roof casing 10 and the reinforcing plate 21 are just sufficient to accommodate the passage of support 20. As can be seen in the figures, the support 20 is welded to the casing reinforcing plate 21 and the casing reinforcing plate 21, in turn, is welded to the roof casing 10. Thus, the support 20 is in thermal contact with and attached to both the metal roof casing 10 and the serpentine tube 16.

It should be readily appreciated that support 20 may be attached to roof casing 10 by other techniques such as providing a threaded portion on the upper end of support 20 and using a nut to retain support 20 in position against reinforcing plate 21.

As is shown in the figures, the hybrid boiler includes horizontally disposed water tubes 22 which generally are arranged so as to run transverse to the direction of the serpentine tubes 16; however, water tubes 22 optionally may run parallel to the direction of the serpentine tubes 16. Also, as is shown, a plurality of support bars 23 are welded to the roof casing 10. Generally U-shaped connectors 24, which are welded to the tubular water pipes 22, hang from the support bar 23 so that the pipes 22 are suspended immediately below the roof casing 10 of the boiler.

In a preferred embodiment of the present invention, the water tubes 22 also are provided with horizonatally arranged fins 25 which serve to enhance the heat transfer efficiency of water tubes 22.

Heat loss to the exterior of the boiler is minimized by means of insulation 28 located, in general, between the top half of tubes 22 and the roof casing 10.

An extremely important feature of support 20 is that a liquid charge, shown as reference numeral 34 in FIG. 2, is sealed within support 20 by tube sealing members 35. Any non-corrosive liquid which will reflux under conditions of use of the boiler can be employed. One such liquid is mineral free deareated water.

The amount of liquid employed is not critical. In general, the liquid will be sufficient to substantially fill that portion of the support 20 which extends below the water tubes 22. Typically, the liquid charge will be at atmospheric pressure at room temperature; however, the liquid may optionally be at reduced pressure.

Optionally, support 20 may also be provided with a small needle valve (not shown) for maintaining a check on the condition of the support.

In operation, the support 20 is cooled not only by heat being conducted by the metal support 20 to the relatively cooler roof casing 10 and the serpentine tube 16, but also by vaporization of the liquid in contact with the portion of the support 20 within the boiler which liquid, after vaporization, condenses at the end of the support 20 outside the boiler and in contact with the roof casing 10, where it gives up its heat to the atmosphere and returns by gravity to the portion of the support 20 for repeat of the cycle.

Although it is not essential, it is generally preferred that support 20 be further protected by providing a metal sleeve 30 which extends downwardly from a position intermediate channel member 12 to the top surface of the upper bend portion 17 of tubes 16 and an insulating material 32, such as refractory insulation, ceramic fibers and the like, is located within the tubular sleeve 30. In this way, contact of the support 20 with hot gases is minimized.

As will be readily appreciated, there are many benefits to be gained by the practice of the present invention. For example, since the process tubes 16 are supported within the convection section of the boiler, the entire process tube surface serves as a heat input surface. In boiler designs such as that set forth in U.S. Pat. No. 3,385,271, where the process tubes penetrate the roof casing for external support, the effective heat input surface area of the tubes are significantly reduced. Consider also that tube surfaces located outside of the boiler provide a means for increased heat loss. Then too expansion joint are not required in the casing when the process tubes are supported in accordance with the present invention, thereby avoiding the problem of air leakage from or into the boiler. Moreover, fabrication and erection are simplified because roof penetrations are eliminated or simplified, except for the inlet and outlet connections of the process tubes. Very importantly, since the supports are fabricated from common pipe components, the need for unusually designed parts with their associated higher costs is avoided.

What is claimed is:

1. In a hybrid boiler, a metal roof casing, insulation below said roof casing, horizontally disposed water tubes below said roof casing, at least one serpentine process tube below said water tubes, said serpentine tube having substantially parallel and spaced apart vertical straight run portions joined by upper and bottom bend portions, tubular metal supports in thermal contact with and attached to the upper bend portions of said process tube, said metal supports extending upwardly through the insulation and through the roof casing, said metal supports being in thermal contact with and attached to said roof casing being sealed and containing a vaporizable liquid therein whereby under conditions of use said supports are cooled by vaporization of said liquid in contact with a relatively hot portion of the supports, the condensation of the vaporized liquid in a relatively cool portion of the support and the return of the condensed liquid by gravity to the portion of the support extending below the roof casing.

2. The boiler of claim 1 wherein the liquid within the support is a non-corrosive liquid.

3. The boiler of claim 2 wherein said liquid is water.

4. The boiler of claim 1 including upwardly directed channels in said roof casing extending the length of said casing, insulation in said channels, said process tube located so that said supports extend upwardly through the insulation in the channel and through the roof casing.

5. The boiler of claim 4 including tubular metal sleeves surrounding the metal supports at least from the insulation in the channel to the upper bend of said tube and defining a space therebetween and insulation in the space between said supports and said metal sleeves.

6. In a hybrid boiler of the type including a metal roof casing with insulation of the bottom surface thereof and a plurality of water tubes horizontally disposed below the insulation and including a plurality of serpentine process tubes having straight run portions, upper bend portions and lower bend portions, said tubes located so that said straight run portions are vertically disposed in said boiler, the improvement comprising metal tubular supports attached to and in thermal contact with the upper bends of said process tubes, said supports extending upwardly through said insulation and being attached to and in thermal contact with said supports having a vaporizable liquid sealed therein whereby under conditions of use said supports are cooled by vaporizing the liquid from one portion of the support below the roof casing and condensing the so vaporized liquid at another portion of the support above the roof casing and wherein said condensed vaporized liquid returns to the portion of support below the roof casing by gravity.

7. The boiler of claim 6 including tubular metal sleeves surrounding the metal supports at least from the insulation to the upper bend of said tube and defining a space therebetween and insulation in the space between said supports and said metal sleeves.

8. The boiler of claim 7 including horizontally disposed water tubes below the roof casing and above the upper bend portions of the process tubes and wherein said liquid sealed in said tubular supports substantially fills that portion of said support which is below said horizontal water tubes.

9. The boiler of claim 8 wherein said liquid in said support is mineral free deareated water.

* * * * *

UNITED STATES PATENT AND TRADEMARK OFFICE

CERTIFICATE OF CORRECTION

PATENT NO. : 4,444,157

DATED : April 24, 1984

INVENTOR(S) : Arthur C. Worley

It is certified that error appears in the above-identified patent and that said Letters Patent is hereby corrected as shown below:

At column 1, after "boilers", please insert the following new paragraph:

--The Government of the United States of America has rights in this invention pursuant to Contract No. DE-FC05-77ET-10069 awarded by the United States Energy Research and Development Administration, now the United States Department of Energy.--

Signed and Sealed this

*Twenty-eighth* Day of *May 1985*

[SEAL]

*Attest:*

DONALD J. QUIGG

*Attesting Officer*

*Acting Commissioner of Patents and Trademarks*